United States Patent [19]

Sato

[11] 4,027,347

[45] June 7, 1977

[54] SWIMMING GLOVE

[76] Inventor: Haruto Sato, Daini Sakuraso, 49-10 Nishikubo 1-Chome, Musashino, Tokyo, Japan

[22] Filed: Aug. 4, 1976

[21] Appl. No.: 711,696

[30] Foreign Application Priority Data

May 21, 1976 Japan ..... 51-64790[U]

[52] U.S. Cl. ..... 9/308
[51] Int. Cl.[2] ..... A63B 31/04
[58] Field of Search ..... 9/301–305, 9/307–309; 2/159, 161 A, 165

[56] References Cited

UNITED STATES PATENTS

| | | | |
|---|---|---|---|
| 1,179,581 | 4/1916 | Virneburg | 9/308 |
| 1,888,867 | 11/1932 | Schmitt | 9/307 |

FOREIGN PATENTS OR APPLICATIONS

| | | | |
|---|---|---|---|
| 23,038 | 2/1906 | Austria | 9/308 |
| 1,542,549 | 10/1968 | France | 9/308 |

*Primary Examiner*—Trygve M. Blix
*Assistant Examiner*—Stuart M. Goldstein
*Attorney, Agent, or Firm*—Woodling, Krost, Granger & Rust

[57] ABSTRACT

A swimming glove comprising an elastic sealable main body which integrally includes a hollow palm portion, a plurality of hollow finger portions radially and outwardly extending from one end of the palm portion and foldable fingerwebs extending between the finger portions; an elastic binding member applied about the other end of the palm portion; a plurality of rockable resisting pieces secured along one side of the palm portion and one of said finger portions, pairs of opposed and spaced resisting piece restraining pieces embracing the resisting pieces therebetween for limiting the movement of the resisting pieces.

5 Claims, 3 Drawing Figures

SWIMMING GLOVE

BACKGROUND OF THE INVENTION

This invention relates to a swimming glove and more particularly to a swimming glove which enables a beginner to swim easily.

There have been proposed and practically employed a variety of devices by means of which swimmers have tried to make an advance in their swimming skill. However, it has been found that they have inherent disadvantages with respect to many aspects.

SUMMARY OF THE INVENTION

Therefore, one object of the present invention is to provide a novel and improved swimming aid device which can eliminate the disadvantages inherent in the prior art swimming aid devices.

Another object of the present invention is to provide a swimming aid device in the form of a glove which is substantially similar to the prior art protection-against-the cold and working gloves, but provided with finger-webs between the adjacent finger portions of the glove so that when the finger portions are spreaded in swimming, the finger-webs are also spreaded to increase the water resisting area of the glove whereby the glove wearer can make an advance in his swimming skill.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

PREFERRED EMBODIMENT OF THE INVENTION

Figure 1:
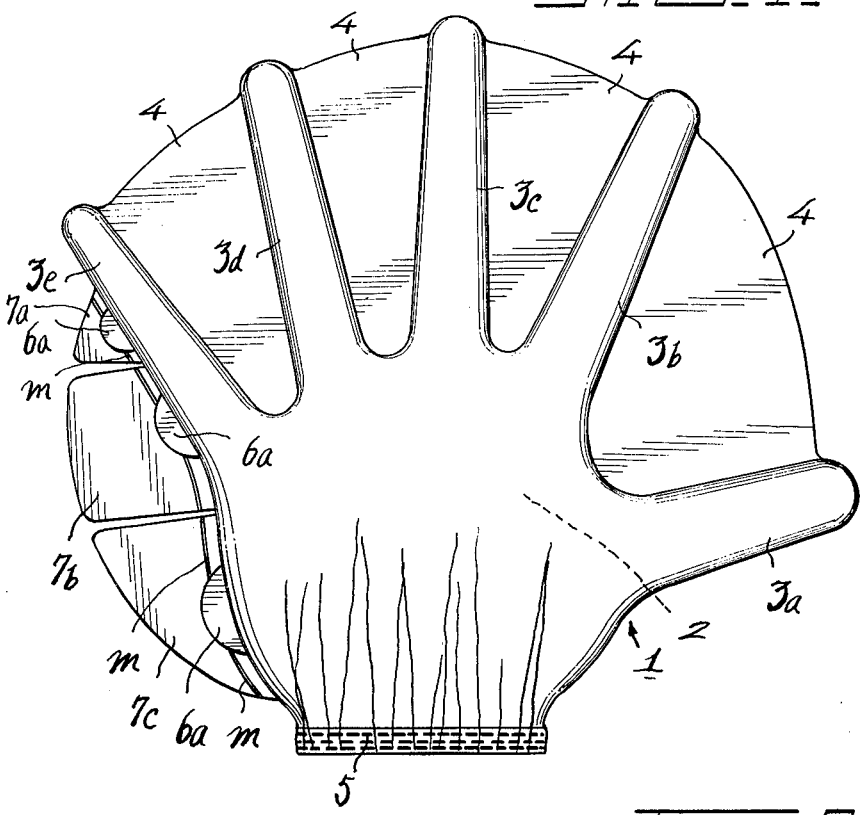
FIG. 1 is a plan view of one preferred embodiment of swimming glove in accordance with the principle of the present invention showing the glove in its fully spreaded state.
Figure 2:
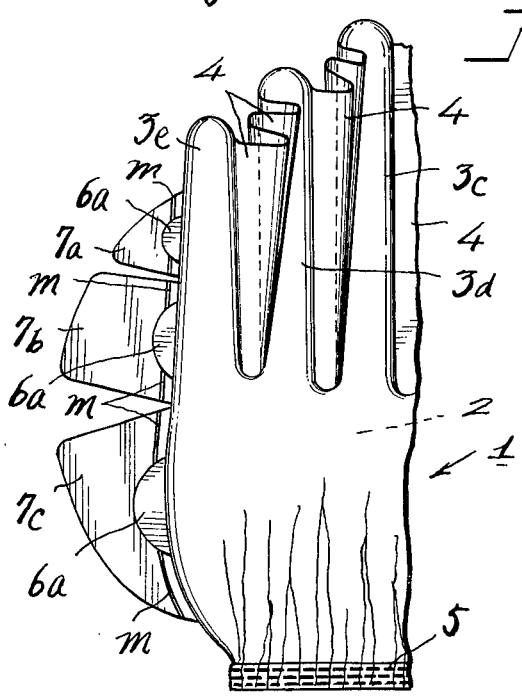
FIG. 2 is a fragmentary plan view of said glove showing the glove in its closed state.

The present invention will be now described referring to the accompanying drawings which show one preferred embodiment of swimming glove of the present invention. The swimming glove generally comprises a hollow sealable main body 1 formed of an elastic material such as natural rubber, synthetic rubber or the like and the main body integrally includes a hollow palm portion 2 and five hollow finger portions 3*a*, 3*b*, 3*c*, 3*d* and 3*e* extending radially and outwardly from one end of the palm portion 2. As in the case of prior art general purpose gloves, the hollow palm portion 2 receives the palm of the user's hand and the hollow finger portions 3*a*, 3*b*, 3*c*, 3*d* and 3*e* receive the thumb, index finger, middle finger, third finger and small finger of the user's hand, respectively. An elastic finger-web 4 which may be formed of the same material as that of the main body 1 extends across and integrally connects between each two adjacent finger portions. The finger-web 4 is integrally connected at the inner end to the palm portion 2 and on the opposite sides to each two adjacent finger portions, respectively. The outer end of the finger-web 4 terminates short of the outer or tip ends of the associated finger portions. When the swimming glove is fully spreaded as shown in FIG. 1, the finger-webs 4 are able to resist the force of water in which the wearer swims and when the swimming glove is folded or closed, the finger-webs 4 may assume the configuration as shown in FIG. 2. The other end or carpus end of the hollow palm portion 2 which surrounds the carpus of the wearer has a binding member 5 formed of an elastic braid, for example, applied thereabout whereby the swimming glove can be sealingly tightened against the carpus of the wearer.

Figure 3:
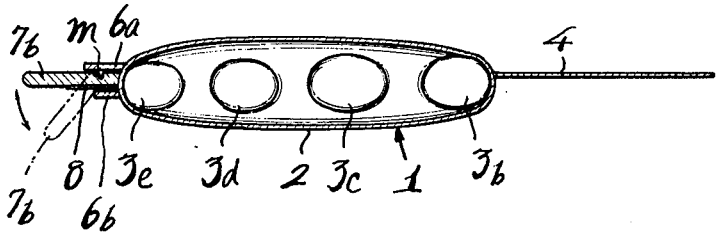
FIG. 3 is a cross-sectional view taken approximately along the transverse mid-section of the glove of FIG. 1.

A plurality of spaced longer restraining pieces 6*a* are secured on one or the inner side to one side of the palm portion 2 and small finger portion 3*e* (or left-hand side as seen in FIG. 1) by suitable means such as welding and the restraining pieces associated with the small finger portion 3*e* are preferably positioned along the left-hand side (as seen in FIG. 1) of the finger portion at areas corresponding to the positions of the articulations of the small finger of a standard adult's hand, respectively. Similarly, a plurality of spaced shorter restraining pieces 6*b* are also secured to the above-mentioned slide of the palm portion 2 and small hand portion 3*e* in face-to face and spaced relationship to the respectively associated longer restraining pieces 6*a*. The longer and shorter restraining pieces 6*a*, 6*b* may be formed of a suitable rigid material different from that for the components of the main body 1. A plurality of spaced fin-shaped resisting pieces 7*a*, 7*b* and 7*c* are also secured on one side to the above-mentioned one side of the palm portion 2 and small finger portion 3*e* by means of welding, for example, between and slightly spaced from the respectively associated opposed longer and shorter restraining pieces 6*a*, 6*b*. The resisting pieces 7*a*, 7*b* and 7*c* extend from the above-mentioned side of the palm and small finger portions 2, 3*e* by a distance greater than that by which the restraining pieces 6*a*, 6*b* extend from the palm and small finger portion side. The size of the fin-shaped resisting pieces 7*a*, 7*b* and 7*c* increases as they go downwardly (as seen from top to bottom), that is, the topmost resisting piece 7*a* has the smallest size and the lowermost resisting piece 7*c* has the largest size. Each of the fin-shaped resisting pieces 7*a*, 7*b* and 7*c* comprises a suitable rigid sheet having a pliable rubberized cloth 8 applied to one side thereof facing to the associated shorter restraining piece 6*b* and a folding notch *m* cut in the other side and extending through the full length thereof. The notches *m* in the resisting pieces 7*a*, 7*b* and 7*c* are positioned somewhat inwardly of the outer or free side edges of the respectively associated shorter restraining pieces 6*b*. With the above construction and arrangement of the fin-shaped resisting pieces 7*a*, 7*b* and 7*c* and restraining pieces 6*a*, 6*b*, while the wearer is swimming, when the resisting pieces receive the force of water on the side of the pieces where the notches *m* are cut, the resisting pieces are rocked about the notches *m* toward and to the shorter restraining pieces 6*b* as shown by the phantom line in FIG. 3. The rocking movement of the resisting pieces 7*a*, 7*b* and 7*c* in the one direction is limited by the shorter restraining pieces 6*b*. On the other hand, when the resisting pieces 7*a*, 7*b* and 7*c* receive the force of water on the other side of the pieces where the rubberized cloths 8 are applied, the resisting pieces are able to resist the force of water and maintain a substantially horizontal position (as seen in FIG. 3) parallel to the plane of the palm portion 2 and small finger portion 3*e* by the assistance of the longer restraining pieces 6*a*.

Although not shown, the tips of the finger portions 3*a*, 3*b* and 3*c* may be provided with small air holes so that when the fingers of the wearer's hand are inserted into the finger portions of the glove, air trapped in the finger portions can be discharged from the portions through the air holes and the glove finger portions can positively and closely make contact with the inserted fingers of the wearer's hand.

As clear from the foregoing description of the preferred embodiment of the swimming glove of the present invention, when the elastic finger portions 3*a*, 3*b* and 3*c* radially extending from the palm portion 2 with which the finger portions are integral closely receive the fingers of the wearer's hand, the binding member 5 is tightened about the carpus of the wearer's hand to air-tightly seal the fingers of the wearer's and and the finger portions 3*a*, 3*b* and 3*c* are spreaded in swimming, the finger-webs 4 between the finger portions are also spreaded to increase the water resisting area of the swimming glove and the swimming glove enables even a beginner to swim easily and thus by the use of the swimming glove, the beginner may make advance in his learning how to swim. And when the swimming glove is used in conjunction with a life-saving outfit, the glove will do much toward lifesaving.

Furthermore, since the web-fingers 4 between the finger portions are thin and fold easily, the wearer can easily and positively grip and article or articles while swimming.

While only one embodiment of the invention has been shown and described in detail it will be understood that the same is for illustration purpose only and not to be taken as a definition of the invention, reference being had for this purpose to the appended claims.

What is claimed is:

1. A swimming glove comprising an elastic and sealable hollow main body which integrally includes a hollow palm portion, a plurality of spaced hollow finger portions extending radially and outwardly of said palm portion and plurality of foldable finger-webs each extending between adjacent ones of said finger portions; a binding member applied about the carpus end of said palm portion for sealingly tightening the glove to one hand of the wearer; a plurality of spaced rockable water resisting pieces secured on one side to one side of said palm portion and one of said hollow finger portions; a first plurality of spaced rigid restraining pieces disposed adjacent to one side of said water resisting pieces for limiting the movement of said resisting pieces in one direction; and a second plurality of spaced rigid restraining pieces disposed adjacent to the other side of said water resisting pieces for limiting the movement of said water resisting pieces in the other direction.

2. The swimming glove as set forth in claim 1, in which said hollow finger portions are thumb, index finger, middle finger, third finger and small finger portions, respectively, for receiving the thumb, index finger, middle finger, third finger and small finger on one hand of the wearer, respectively.

3. The swimming glove as set forth in claim 1 in which said water resisting pieces and first and second restraining pieces are secured to and extend from one side of said hollow small finger portion and hollow palm portion.

4. The swimming glove as set forth in claim 1, in which said first and second restraining pieces embrace said water resisting piece in a spaced relationship thereto.

5. The swimming glove as set forth in claim 1, in which said water resisting pieces each comprises a rigid sheet having a pliable rubberized cloth applied to one side of the rigid sheet and a notch cut in the other side of the rigid sheet.

* * * * *